US010667655B2

(12) United States Patent
Ciavarella et al.

(10) Patent No.: US 10,667,655 B2
(45) Date of Patent: Jun. 2, 2020

(54) DISPENSERS, REFILL UNITS AND PUMPS HAVING VACUUM ACTUATED ANTI-DRIP MECHANISMS

(71) Applicant: GOJO Industries, Inc., Akron, OH (US)

(72) Inventors: Nick E. Ciavarella, Seven Hills, OH (US); Aaron D. Marshall, Uniontown, OH (US); Donald Russell Harris, Tallmadge, OH (US); Dennis K. Jenkins, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 19 days.

(21) Appl. No.: 15/901,413

(22) Filed: Feb. 21, 2018

(65) Prior Publication Data

US 2018/0235410 A1 Aug. 23, 2018

Related U.S. Application Data

(60) Provisional application No. 62/461,907, filed on Feb. 22, 2017.

(51) Int. Cl.
*A47K 5/14* (2006.01)
*B05B 11/00* (2006.01)

(52) U.S. Cl.
CPC ..... *A47K 5/14* (2013.01); *B05B 11/3087* (2013.01); *B05B 11/3097* (2013.01)

(58) Field of Classification Search
CPC ..... A47K 5/12; A47K 5/14; A47K 5/1204; A47K 5/1207; B05B 11/3078; B05B 11/3087; B05B 11/3097; B65D 47/40
See application file for complete search history.

(56) References Cited

U.S. PATENT DOCUMENTS 4,165,824 A * 8/1979 Sud ..... A47K 5/1204 222/341
4,519,526 A * 5/1985 Hillman ..... G01F 11/00 222/212

(Continued)

FOREIGN PATENT DOCUMENTS

WO 2015048698 A1 4/2015
WO 2015183775 A1 4/2015

OTHER PUBLICATIONS

International Search Report from PCT/US2018/019001dated Jun. 5, 2018 (11 pages).

*Primary Examiner* — Patrick M. Buechner
(74) *Attorney, Agent, or Firm* — Calfee, Halter & Griswold LLP

(57) ABSTRACT

A fluid dispenser includes a dispenser housing, a container for holding a foamable liquid, a foam pump, an outlet in fluid communication with the foam pump, and a vacuum actuated suck-back mechanism in fluid communication with the foam pump and the outlet. The foam pump has a liquid pump portion and an air pump portion. The vacuum actuated suck-back mechanism includes a chamber and a movable member. The chamber has a vacuum port that is in fluid communication with the air pump portion of the foam pump, and a suck-back port that is in fluid communication with the outlet. The movable member of the vacuum actuated suck-back mechanism moves under vacuum pressure to reduce the volume of the chamber. The volume of the chamber increases upon removal of the vacuum pressure.

20 Claims, 5 Drawing Sheets

(56) References Cited

U.S. PATENT DOCUMENTS 5,779,104 A * 7/1998 Reidel ..... A45D 27/10 222/190
5,842,605 A * 12/1998 Lehmkuhl ..... B05B 11/3001 222/95
5,897,031 A * 4/1999 Wirt ..... A47K 5/1204 222/179
2002/0125271 A1* 9/2002 Zeitlin ..... A47K 5/1204 222/181.3
2002/0139816 A1* 10/2002 Powling ..... A47K 5/1204 222/341
2005/0276707 A1* 12/2005 Ophardt ..... A47K 5/1207 417/437
2006/0071033 A1* 4/2006 Lewis ..... A47K 5/12 222/321.9
2006/0108380 A1 5/2006 Ciavarella
2006/0213434 A1* 9/2006 Ganzer ..... B05C 5/0204 118/300
2007/0251953 A1* 11/2007 Criswell ..... A47K 5/1207 222/105
2009/0101679 A1* 4/2009 Muderlak ..... A47K 5/16 222/375
2010/0224651 A1* 9/2010 Zlatic ..... A47K 5/122 222/182
2011/0056990 A1 3/2011 Proper et al.
2012/0248149 A1 10/2012 Pelfrey
2013/0075420 A1* 3/2013 Tramontina ..... A47K 5/1205 222/1
2013/0094983 A1* 4/2013 Pelfrey ..... A47K 5/14 417/472
2013/0233441 A1* 9/2013 Ciavarella ..... B05B 7/0025 141/18
2013/0299517 A1 11/2013 Ciavarella et al.
2013/0341358 A1 12/2013 Ciavarella et al.
2014/0054322 A1 2/2014 McNulty et al.
2014/0054323 A1 2/2014 McNulty et al.
2014/0061246 A1 3/2014 McNulty et al.
2014/0124540 A1 5/2014 Ciavarella et al.
2014/0205473 A1 7/2014 Ciavarella et al.
2014/0261799 A1 9/2014 Ciavarella et al.
2014/0263462 A1 9/2014 Quinlan et al.
2015/0090737 A1 4/2015 Ciavarella et al.
2015/0335208 A1 11/2015 Ciavarella et al.
2016/0010798 A1* 1/2016 Hori ..... F17C 5/04 137/1
2018/0043390 A1* 2/2018 Rospierski ..... B05B 11/3053
2019/0328181 A1* 10/2019 Ciavarella ..... A47K 5/14

* cited by examiner

DISPENSERS, REFILL UNITS AND PUMPS HAVING VACUUM ACTUATED ANTI-DRIP MECHANISMS

BACKGROUND

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles.

Liquid dispensing systems often include an outlet that is disposed in a downward position. The downward position of the outlet may allow the dispensing system to drip liquid (or foam) after the dispensing system is activated. The dripped liquid makes a mess in certain circumstances and may create a hazard. Certain dispensing systems utilize check valves, drip pans, and suck-back mechanisms to prohibit the dispensing systems from dripping liquid (or foam) on a surface below the dispensing system.

SUMMARY

Exemplary embodiments of fluid dispensers and methodologies for dispensing fluids are provided herein. An exemplary fluid dispenser includes a dispenser housing, a container for holding a foamable liquid, a foam pump, an outlet in fluid communication with the foam pump, and a vacuum actuated suck-back mechanism in fluid communication with the foam pump and the outlet. The foam pump has a liquid pump portion and an air pump portion. The vacuum actuated suck-back mechanism includes a chamber and a movable member. The chamber has a vacuum port that is in fluid communication with the air pump portion of the foam pump, and a suck-back port that is in fluid communication with the outlet. The movable member of the vacuum actuated suck-back mechanism moves under vacuum pressure to reduce the volume of the chamber. The volume of the chamber increases upon removal of the vacuum pressure.

Another exemplary fluid dispenser includes a dispenser housing, a container for holding a foamable liquid, a first pump portion for pumping a liquid, a second pump portion for pumping air, an outlet in fluid communication with the first pump portion, and a chamber at least partially defined by a movable member. The chamber has a vacuum inlet that is in fluid communication with the air pump portion, and a suck-back inlet that is in fluid communication with the outlet. Applying a vacuum pressure to the vacuum inlet causes the volume of the chamber to decrease, and removing the vacuum pressure from the vacuum inlet causes the volume of the chamber to increase. Increasing the volume of the chamber draws residual fluid from the outlet toward the chamber.

Exemplary methodologies for providing a fluid dispenser are provided herein. An exemplary methodology includes providing a container of foamable liquid and a foam pump. The foam pump has an inlet in fluid communication with the container and an outlet for dispensing foam. In addition, the exemplary methodology includes providing a vacuum actuated suck-back mechanism, in which the vacuum actuated suck-back mechanism has a chamber that is in fluid communication with the outlet. The volume of the chamber decreases upon applying a vacuum pressure to the chamber, and the volume of the chamber increases upon removing the vacuum pressure from the chamber. Increasing the volume of the chamber draws residual fluid from the outlet toward the chamber.

DETAILED DESCRIPTION

The Detailed Description describes exemplary embodiments of the invention and is not intended to limit the scope of the claims in any way. Indeed, the invention is broader than and unlimited by the exemplary embodiments, and the terms used in the claims have their full ordinary meaning. Features and components of one exemplary embodiment may be incorporated into the other exemplary embodiments. Inventions within the scope of this application may include additional features, or may have less features, than those shown in the exemplary embodiments.

Figure 1:
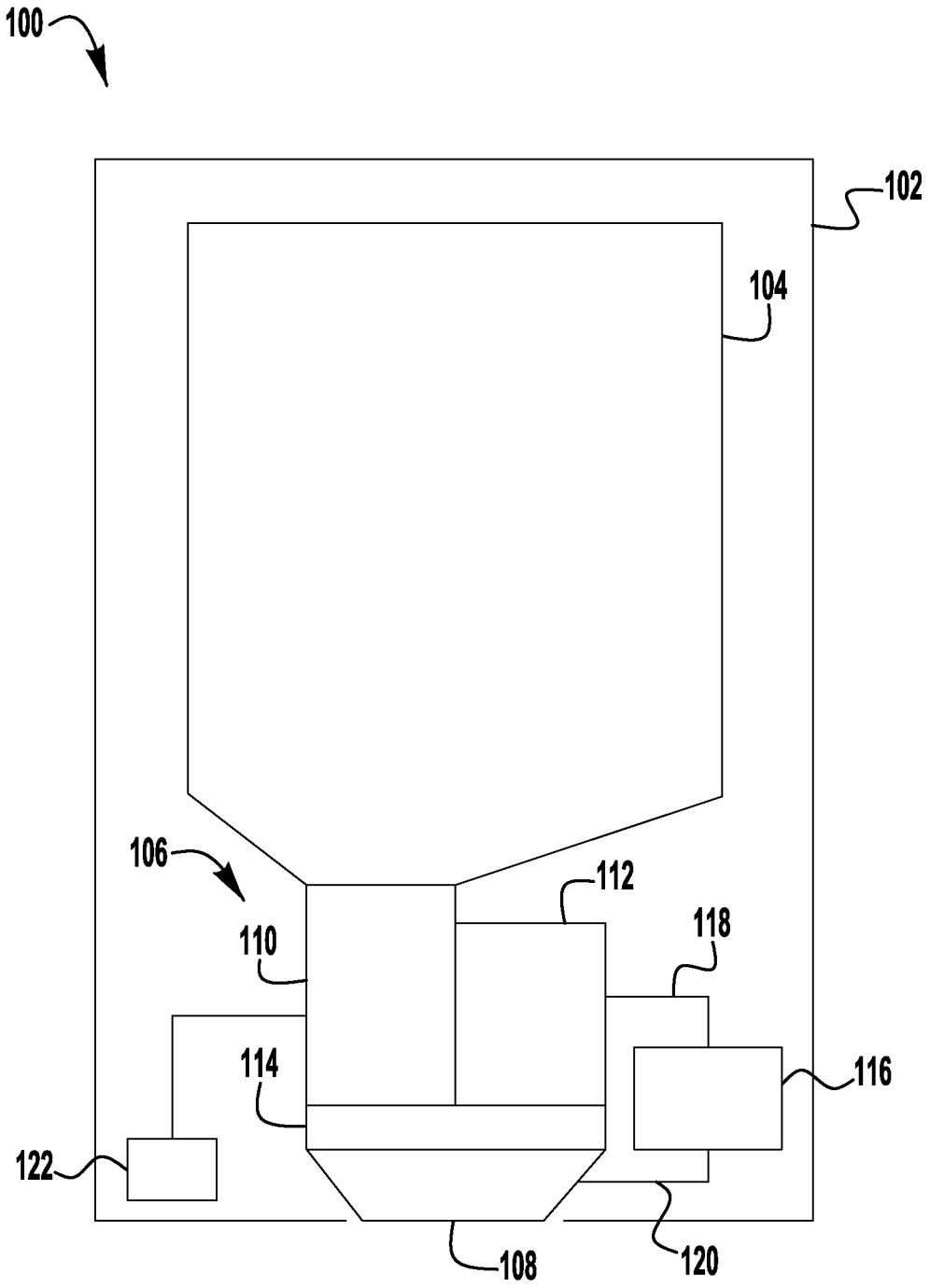
FIG. 1 is a cross-sectional view of an exemplary embodiment of a dispenser having a vacuum actuated suck-back mechanism for preventing residual foam or liquid from dripping out of an outlet of the dispenser.

Referring to FIG. 1, an exemplary embodiment of a dispenser 100 includes a housing 102, a container 104 for holding a foamable liquid, a foam pump 106, an outlet 108, and a vacuum actuated suck-back mechanism 116. The foamable liquid may be, for example, soap, sanitizer, lotion, etc. The foam pump 106 includes a liquid pump portion 110 and an air pump portion 112. In some exemplary embodiments, the dispenser 100 may include a foaming cartridge 114. In certain of these exemplary embodiments, a liquid pump portion 110 pumps liquid from the container into a mixing chamber (not shown) and the air pump portion 112 pumps air into the mixing chamber (not shown) to mix with the liquid. The liquid-air mixture (i.e., a foamy mixture) travels through the foaming cartridge 114 to create a rich foam, and the rich foam exits the dispenser 100 through the outlet 108. Exemplary embodiments of foam pumps are shown and described in, U.S. Pat. No. 7,303,099 titled Stepped Pump Foam Dispenser; U.S. Pat. No. 8,002,150 titled Split Engagement Flange for Soap Piston; U.S. Pat.

No. 8,091,739 titled Engagement Flange for Fluid Dispenser Pump Piston; U.S. Pat. No. 8,113,388 titled Engagement Flange for Removable Dispenser Cartridge; U.S. Pat. No. 8,272,539, Angled Slot Foam Dispenser; U.S. U.S. Pat. No. 8,272,540 titled Split Engagement Flange for Soap Dispenser Pump Piston; U.S. Pat. No. 8,464,912 titled Split Engagement Flange for Soap Dispenser Pump Piston; U.S. Pat. No. 8,360,286 titled Draw Back Push Pump; U.S. Provisional Pat. Ser. No. 62/293,931 titled High Quality Non-Aerosol Hand Sanitizing Foam; U.S. Provisional Pat. Application Ser. No. 62/257,008 Sequentially Activated Multi-Diaphragm Foam Pumps, Refill Units and Dispenser Systems; U.S. Pat. No. 8,172,555 titled Diaphragm Foam Pump; U.S. 2008/0,277,421 titled Gear Pump and Foam Dispenser, all of which are incorporated herein by reference in their entirety. Exemplary embodiments of foaming cartridges 114 are shown and described in U.S. Publication No. 2014/0367419 titled Foaming cartridges, Pump, Refill Units and Foam Dispensers Utilizing The Same, which is incorporated herein by reference in its entirety. In various embodiments, any combination of the container 104, the foam pump 106, the outlet 108, and the vacuum actuated suck-back mechanism 116 may be a part of a refill unit. In certain embodiments, the foam pump 106 and the vacuum actuated suck-back mechanism 116 are fixed to the housing 102 of the dispenser 200.

The vacuum actuated suck-back mechanism 116 is configured to prevent foam from dripping from the outlet 108 after foam is dispensed out of the outlet. That is, after foam is pumped from the outlet 108, some residual foam remains in the outlet, and the foam and/or foamable liquid that remains in the outlet often drips out of the outlet. The vacuum actuated suck-back mechanism 116 is configured to prevent the foam that remains in the outlet 108 from dripping out of the outlet. The vacuum actuated suck-back mechanism 116 is in fluid communication the outlet 108 and the inlet of air pump portion 112 of the foam pump 106. In certain embodiments, the dispenser 100 includes a vacuum line 118 that is in fluid communication with the vacuum actuated suck-back mechanism 116 and the air pump portion 112 of the foam pump 106. In some embodiments, the dispenser 100 may include a conduit 120 that is in fluid communication with the vacuum actuated suck-back mechanism 116 and the outlet 108.

During operation of the dispenser 100, the foam pump 106 is activated using an actuator 122. In various embodiments, the dispenser 100 is a "touch free" dispenser and includes an actuator 122 that activates the pump 106 to pump liquid from the container 104 out of the outlet 108 of the dispenser 100. Exemplary touch-fee dispensers are shown and described in U.S. Pat. No. 7,837,066 titled Electronically Keyed Dispensing System And Related Methods Utilizing Near Field Response; U.S. Pat. No. 9,172,266 title Power Systems For Touch Free Dispensers and Refill Units Containing a Power Source; U.S. Pat. No. 7,909,209 titled Apparatus for Hands-Free Dispensing of a Measured Quantity of Material; U.S. Pat. No. 7,611,030 titled Apparatus for Hans-Free Dispensing of a Measured Quantity of Material; U.S. Pat. No. 7,621,426 titled Electronically Keyed Dispensing Systems and Related Methods Utilizing Near Field Response; and U.S. Pat. No. 8,960,498 titled Touch-Free Dispenser with Single Cell Operation and Battery Banking; all which are incorporated herein by reference. In embodiments that include a touch-free feature, the dispenser 100 may include a power source (not shown), a sensor (not shown), a controller (not shown), and a motor (not shown). The power source is in electrical communication with and provides power to the sensor, controller, and motor. The power source may be an internal power source, such as, for example, one or more batteries or an external power source, such as, for example, solar cells, or a conventional 120 VAC power supply. In alternative embodiments the dispenser is a manual dispenser. In such embodiments, the actuator 122 may require manual activation, such as, for example, a user engages a push bar, a user engages a foot pedal, a pushbutton, or the like. In some embodiments that require manual activation, a push bar (not shown) is mechanically coupled to the pump 106 and, when a user engages the push bar, the pump causes liquid from the container 104 to exit the outlet 108 of the dispenser 100. The term "actuator" as used herein may incorporate one or more of the components in the reference is incorporated herein as needed to cause the foam pump to dispense foam and the vacuum actuated suck-back mechanism 116 to perform as described herein.

During operation, activation of the foam pump 106 causes the liquid pump portion 110 to pump liquid from the container 104 and the air pump portion 112 to pump air to mix with the liquid. In addition, activation of the foam pump 106 causes the air pump portion 112 to create a vacuum in the vacuum actuated suck-back mechanism 116. That is, the inlet of the air pump portion 112 is in fluid communication with the vacuum actuated suck-back mechanism 116, and the dispenser is configured such that as the air pump portion pumps air, a vacuum is created in the vacuum actuated suck-back mechanism 116. Upon deactivation of the foam pump, an after-vacuum impulse is created in the vacuum actuated suck-back mechanism 116, which causes foam that remains in the outlet 108 to be drawn into the vacuum actuated suck-back mechanism 116. That is, the vacuum actuated suck-back mechanism 116 is in fluid communication with the outlet 108, and the after-vacuum impulse in the vacuum actuated suck-back mechanism draws foam that remains in the outlet into the suck-back mechanism. For example, the vacuum actuated suck-back mechanism 116 may include a chamber (not shown) that is in fluid communication with the outlet 108 and the air pump portion 112 of the foam pump 106, and the vacuum actuated suck-back mechanism 116 may be configured such that, when a vacuum is created in the vacuum actuated suck-back mechanism 116, the volume of the chamber is reduced, and, when vacuum is removed from the suck-back mechanism, the volume of the chamber expands to its original size. In this example, the expansion of the volume of the chamber of the vacuum actuated suck-back mechanism 116 causes the residual foam and/or liquid remaining in the outlet 108 to be drawn back into the chamber of the vacuum actuated suck-back mechanism 116, which prevents the remaining foam from dripping out of the outlet. The Sequentially Activated Multi-Diaphragm Foam Pumps, Refill Units and Dispenser Systems that are incorporated herein are particularly well-suited for use in the exemplary embodiments disclosed herein.

Figure 3:
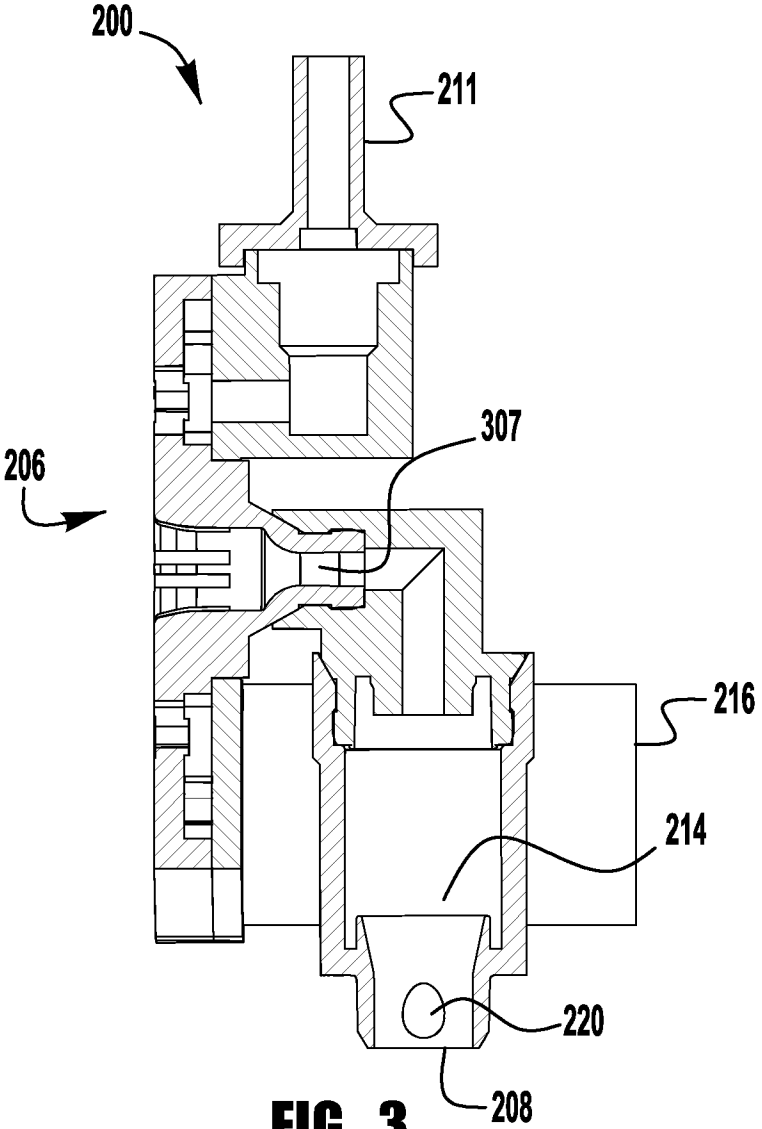
FIG. 3 is a cross-sectional view of the exemplary dispenser of FIG. 2.
Figure 2:
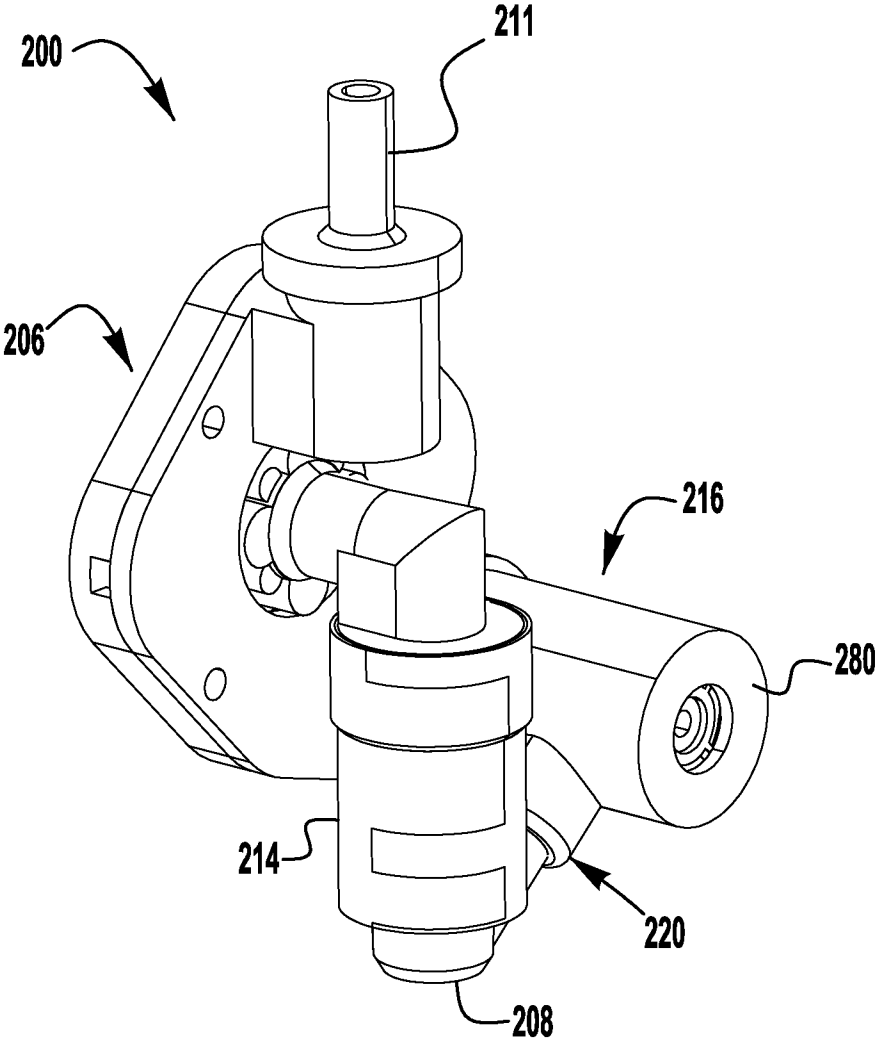
FIG. 2 is a perspective view of another exemplary embodiment of a dispenser having a vacuum actuated suck-back mechanism for preventing residual foam or liquid from dripping out of an outlet of the dispenser.

FIGS. 2-6 illustrate another exemplary embodiment of a portion of a dispenser 200. Referring to FIGS. 2-3, the exemplary dispenser 200 includes a housing (not shown), a container (not shown) for holding a foamable liquid, a foam pump 206, an outlet 208, and a vacuum actuated suck-back mechanism 216. In certain embodiments, the foam pump 206 includes a liquid pump portion and an air pump portion. In this exemplary embodiment, foam pump 206 is a four chamber diaphragm foam pump with four pumping chambers, shown and described in U.S. patent application Ser. No. 15/480,711 titled Sequentially Activated Multi-Diaphragm Foam Pumps, Refill Units and Dispenser Systems; which is incorporated herein in its entirety by reference. One pump chamber pumps liquid (the "liquid pump portion") and three pump chambers pump air (the "air pump portion"). The inlet to one or more of the air pump chambers provide the vacuum for vacuum actuated suck-back mechanisms 216. Upon activation of the foam pump 206, the liquid pump portion pumps liquid into a mixing chamber 307, the air pump portion pumps air into the mixing chamber to mix with the liquid in order to create a foamy mixture, and the foamy mixture exits the outlet 208 of the dispenser. The foam pump 206 includes a liquid inlet 211, and a container (not shown) is configured to attach to the foam pump 206 such that the liquid inlet 211 is in fluid communication the interior of the container. The foam pump 206 may take any suitable form that allows the foam pump to pump air and liquid through the outlet 208 of the dispenser 200, and to create a vacuum to activate vacuum actuated suck-back mechanism 216, such as, for example, any form disclosed in the present application. For example, the foam pump 206 may take any form described in the present application. In certain embodiments, a second air pump may be used to create the vacuum in suck-back mechanism 216. In some embodiments, a separate liquid pump may be used to pump liquid, and a separate air pump may be used to pump air and create vacuum in the vacuum actuated suck-back mechanism to 216. In addition, in certain embodiments, the dispenser 200 includes a foaming cartridge 214, and the foaming cartridge 216 may take any suitable form that allows the foaming cartridge to turn a foamy-mixture into a rich foam, such as, for example, any form described, or incorporated, in the present application. Additionally, the dispenser 200 includes an actuator (not shown) that is used to activate the foam pump 206 in order to pump foam out of the outlet 208, and the actuator may take any suitable form that is capable of activating the foam pump, such as, for example, any form described, or incorporated in, the present application. In various embodiments, any combination of the container, the foam pump 206, the outlet 208, and the vacuum actuated suck-back mechanism 216 may be a part of a refill unit. The term refill unit as used herein includes the container (not shown) and is removable and replaceable to provide the dispenser with additional foamable liquid. In certain embodiments, the foam pump 206 and the vacuum actuated suck-back mechanism 216 are fixed to the housing of the dispenser 200.

The vacuum actuated suck-back mechanism 216 is configured to prevent foam from dripping from the outlet 208 after foam is dispensed out of the outlet. That is, after foam is dispensed from the outlet 208, some residual foam/liquid remains in the outlet, and the foam/liquid that remains in the outlet often drips out of the outlet 208. The vacuum actuated suck-back mechanism 216 prevents the foam that remains in the outlet 208 from dripping out of the outlet 208. The vacuum actuated suck-back mechanism 216 is in fluid communication the outlet 208 and at least a portion of the air pump portion of the foam pump 206. The dispenser 200 includes a conduit 220 that is in fluid communication with vacuum actuated suck-back mechanism 216 and the outlet 208. In addition, the vacuum actuated suck-back mechanism 216 may include channels 452 (FIGS. 4-6) that are in fluid communication with the air pump portion of the foam pump 206. In the illustrated embodiment, the chamber 424 (FIGS. 4-6) of the vacuum actuated suck-back mechanism 216 is oriented longitudinally with the foam pump 206. In alternative embodiments, the chamber 424 of the vacuum actuated suck-back mechanism 216 may be orientated with the foam pump 206 in any manner that allows the chamber to be in fluid communication with the foam pump.

Figure 6:
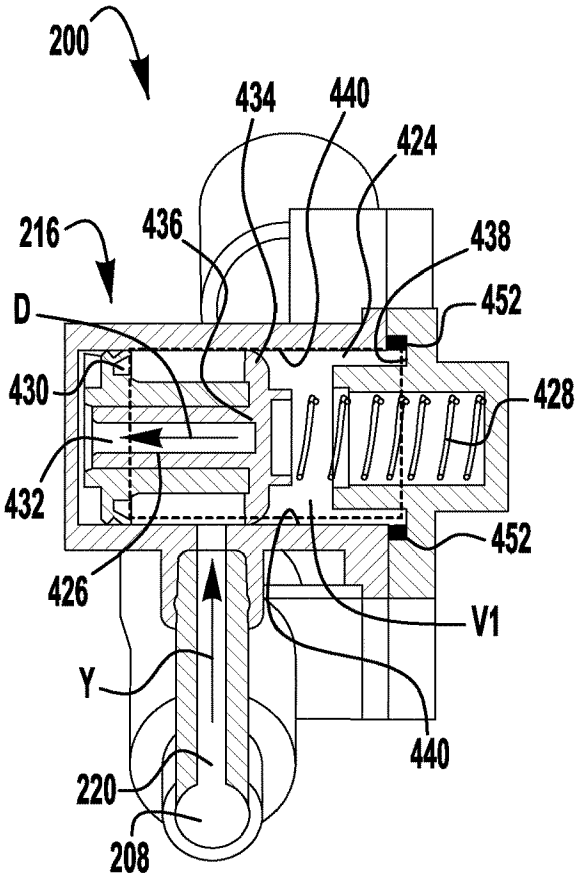
FIG. 6 is a cross-sectional view of the vacuum actuated suck-back mechanism of the exemplary dispenser of FIG. 2, as it is moving from the dispensing position to the rest position.
Figure 5:
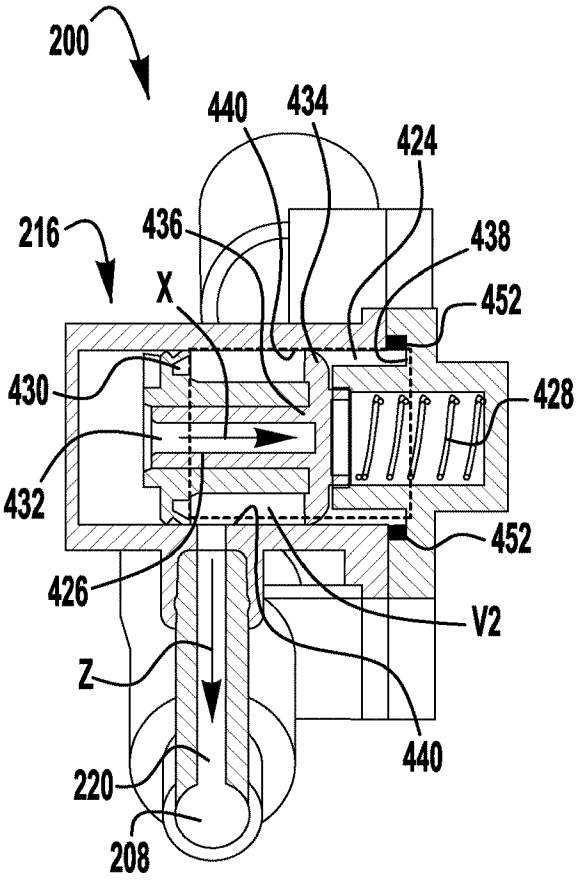
FIG. 5 is a cross-sectional view of the vacuum actuated suck-back mechanism of the exemplary dispenser of FIG. 2, in a foam dispensing position.
Figure 4:
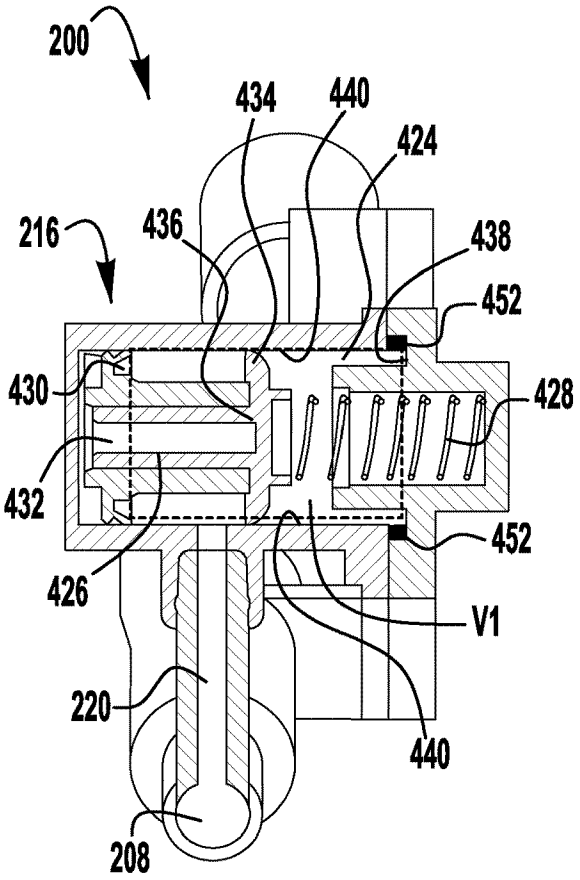
FIG. 4 is a cross-sectional view of the vacuum actuated suck-back mechanism of the exemplary dispenser of FIG. 2, in which the vacuum actuated suck-back mechanism is in an rest position.

Referring to FIGS. 4-6, the vacuum actuated suck-back mechanism 216 includes a chamber 424, a piston 426, and a biasing member 428. The piston 426 has a sealing member 430 at a first end 432 and a dynamic sealing member 434 (i.e., a leaky seal) at a second end 436. The chamber 424 is at least partially defined by the sealing member 430, a chamber end wall 438 opposite the sealing member 430, and a cylindrical side wall 440. The sealing member 430 prevents liquid from moving past the sealing member 430 and out of the chamber 424 through aperture 280 (FIG. 2). In addition, aperture 280 allows air to flow in and out of the area behind sealing member 430, which prevents the sealing member 430 from locking (i.e., prevents the sealing member 430 from being unable to move). The sealing member 430 may be, for example, a wiper seal, a ring seal, double wiper seal, or the like. The dynamic sealing member 434 is a normally loose seal, which means that some liquid may be able to move past the dynamic sealing member 434. However, when the dynamic sealing member 434 is subjected to a vacuum, the dynamic sealing member 434 flexes, or expands, and a prevents liquid (or substantially prevents liquid) from moving past the dynamic sealing member 434. The dynamic sealing member 434 is a wiper seal, however, dynamic sealing member 434 may be any type of dynamic sealing member that allows fluid to pass one in a relaxed state substantially prevents fluid from passing by one in a flexed state, or active state. In addition, the dynamic sealing member 434 may be made of, any flexible material such as, for example, plastic, thermoplastic, silicone, rubber, TPE, PE, and the like. The biasing member 428 is configured to keep the piston in a first position, which is illustrated in FIGS. 4 and 6. The biasing member 428 may be, for example, a spring, resilient plastic, resilient thermoplastic. During operation of the dispenser 200, which will be described in more detail below, the piston 426 moves from a first position shown in FIG. 4 to a second position shown in FIG. 5. When the piston 426 is in the first position, the chamber 424 has a first volume V1, and, when the piston 426 is in the second position, the chamber 424 has a second volume V2 that is less than the first volume V1.

FIGS. 4-6 illustrate the movement of the vacuum actuated suck-back mechanism 216 during operation of the dispenser 200. Referring to FIG. 4, the vacuum actuated suck-back mechanism 216 remains in an rest position when the dispenser 200 dispensing a product. When the vacuum actuated suck-back mechanism 216 is in the rest position, the piston 426 is in the first position, and accordingly the chamber has the first volume V1. The piston 426 is biased to the first position by the biasing member 428.

Referring to FIG. 5, the piston 426 moves to the second position upon activation of the foam pump 206, because foam pump 206 creates a vacuum in chamber 424 of the vacuum actuated suck-back mechanism 216. The vacuum causes dynamic sealing member 434 to flex in seal against the chamber wall 440 in form a seal which moves the piston 426 in the direction X to the second position. The vacuum is created in the vacuum actuated suck-back mechanism 216 through one or more channels 452 that extend between the vacuum actuated suck-back mechanism 216 and the inlet of air pump portion of the foam pump 206. As the air pump portion of the foam pump 206 pumps air into a mixing chamber 307 (FIG. 3) it draws air out of chamber 424 of the vacuum actuated suck-back mechanism. When the piston 426 is in the second position, the chamber 424 has the second volume V2, which is less than the first volume V1.

In addition to creating a vacuum in the vacuum actuated suck-back mechanism 216, activation of the foam pump 206 causes any residual foam/liquid in chamber 424 to flow out of the outlet 208 of the dispenser 200 in a direction Z. In order to prevent foam from entering the chamber 424 of the vacuum actuated suck-back mechanism 216 through the conduit 220 and moving past the dynamic sealing member 434, the vacuum in the chamber causes the dynamic sealing member 434 to flex outward, which substantially prevents foam, liquid or air from moving past the dynamic sealing member 434. If some foam, liquid, and/or air flow past the dynamics showing member 434, the foam, liquid, and/or air simply flow into the air inlet and are recycled through the foam pump.

As can be seen in FIG. 6, the biasing member 428 causes the piston 426 to move from the second position toward the first position upon deactivation of the foam pump 206. Deactivation of the foam pump 206 removes the vacuum source from the chamber 424 of the vacuum actuated suck-back mechanism 216, which is holding piston 426 in place and allows the force from the biasing member 428 to move the piston 426 in the direction D toward the first position. The movement of the piston 428 from the second position to the first position expands the volume of the chamber 424. When the piston 428 is in the second position, the chamber 424 has a second volume V2, and, when the piston is in the first position, the chamber has a first volume V1, and the first volume V1 is larger than the second volume V2. This expansion of the volume of the chamber 424 causes foam/liquid that remains in the outlet 208 to be sucked into the chamber 424 of the vacuum actuated suck-back mechanism 216 through the conduit 220 in the direction Y. Because the dynamic sealing member 434 relaxes, it allows some foam, liquid, and/or air to move past the dynamic sealing member 434. This foam, liquid, and/or air will be drawn out of the vacuum actuated suck-back mechanism 216 upon the next activation of the foam pump 206, through the air pump portion of the foam pump 206. This foam, liquid, and/or air will be pumped into the mixing chamber 307 (FIG. 3) to mix with air and liquid before being dispensed out of outlet 208. Even though the dynamic sealing member 424 may allow some foam to move past the dynamic sealing member, the dynamic sealing member must be a normally loose seal (i.e., a leaky seal) in order for the chamber to expand and suck in foam, liquids, and/or air that was sucked in from the outlet 208 of the dispenser 200.

After the piston 426 moves from the second position to the first position, the vacuum actuated suck-back mechanism 216 remains in an rest position (i.e. the piston 426 remains in the first position) until another activation of the foam pump 206. While the vacuum actuated suck-back mechanism 216 is in the rest position, foam that was sucked into the vacuum actuated suck-back mechanism 216 after the previous activation of the foam pump 206 remains in the chamber 424. Upon the next activation of the foam pump 206, the foam in the chamber 424 is forced through the conduit 220 and out the outlet 208 of the dispenser 200. Subsequently, referring to FIG. 6, upon deactivation of the foam pump 206, the piston 426 moves in the direction D, which causes the chamber 424 to expand and suck in any foam/liquid remaining in the outlet 208 of the dispenser 200. The above-mentioned process illustrated by FIGS. 4-6 is continuous (i.e., the chamber 424 of the vacuum actuated suck-back mechanism 216 will compress as foam is dispensed out of the outlet 208 upon activation of the foam pump 206 and expand to suck foam/liquid out of the outlet 208 upon deactivation of the foam pump 206).

Figure 7:
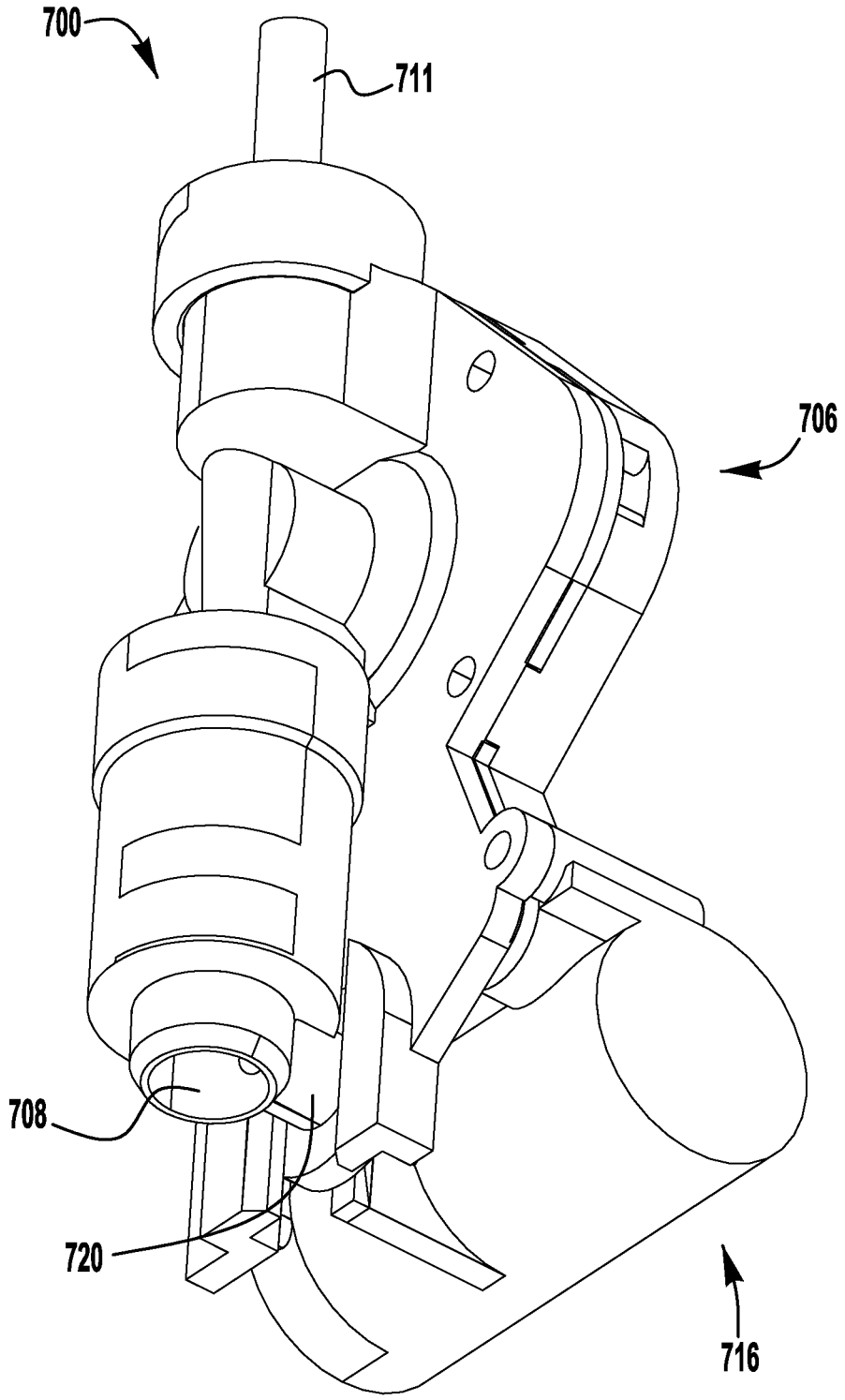
FIG. 7 is a perspective view of another exemplary embodiment of a dispenser having a vacuum actuated suck-back mechanism for preventing residual foam or liquid from dripping out of an outlet of the dispenser.

FIG. 7 illustrates another exemplary embodiment of a portion of a dispenser 700. The exemplary dispenser 700 includes a housing (not shown), a container (not shown) for holding a foamable liquid, a foam pump 706, an outlet 708, and a vacuum actuated suck-back mechanism 716. In certain embodiments, the foam pump 706 includes a liquid pump portion and an air pump portion. Upon activation of the foam pump 706, the liquid pump portion pumps liquid into a mixing chamber (not shown), the air pump portion pumps air into the mixing chamber to mix with the liquid in order to create a foamy mixture, and the foamy mixture exits the outlet 708 of the dispenser. In the illustrated embodiment, the foam pump 706 includes a liquid inlet 711, and the container (not shown) is configured to attach to the pump 706 such that the liquid inlet is in fluid communication the interior of the container (not shown). The foam pump 706 may take any suitable form that allows the foam pump to pump air and liquid through the outlet 708 of the dispenser 700, such as, for example, any form described in the present application. The sequentially activated diaphragm foam pumps incorporated above are particularly useful in this exemplary embodiment. In addition, in certain embodiments, the dispenser 700 includes a foaming cartridge (not shown), and the foaming cartridge may take any suitable form that allows the foaming cartridge to turn a foamy-mixture into a rich foam, such as, for example, any form described in the present application. Additionally, the dispenser 700 includes an actuator (not shown) that is used to activate the foam pump 706 in order to pump foam out of the outlet 708, and the actuator may take any suitable form that is capable of activating the foam pump, such as, for example, any form described in, or incorporated in, the present application. In various embodiments, any combination of the container, the foam pump 706, the outlet 708, and the vacuum actuated suck-back mechanism 716 may be a part of a refill unit. In certain embodiments, the foam pump 706 and the vacuum actuated suck-back mechanism 716 are fixed to the housing of the dispenser 700.

The vacuum actuated suck-back mechanism 716 is configured to prevent residual foam/liquid from dripping from the outlet 708 after foam is dispensed. The vacuum actuated suck-back mechanism 716 prevents the foam that remains in the outlet 708 from dripping out. The vacuum actuated suck-back mechanism 716 is in fluid communication the outlet 708 and the air pump portion of the foam pump 706. In certain embodiments, the dispenser 700 includes a conduit 720 that is in fluid communication with suck back mechanism 716 and the outlet 708. In the illustrated embodiment, the chamber (not shown) of the vacuum actuated suck-back mechanism 716 is oriented transversely with the foam pump 706, which allows for reduction in height. In alternative embodiments, the chamber of the vacuum actuated suck-back mechanism 716 may be orientated with the foam pump 706 in any manner that allows the chamber to be in fluid communication with the foam pump 706. The vacuum actuated suck-back mechanism 716 may take any suitable form that is capable of sucking foam/liquid out of the outlet 708, through the application of the vacuum pressure, such as, for example, any form disclosed in the present application.

Figure 8:
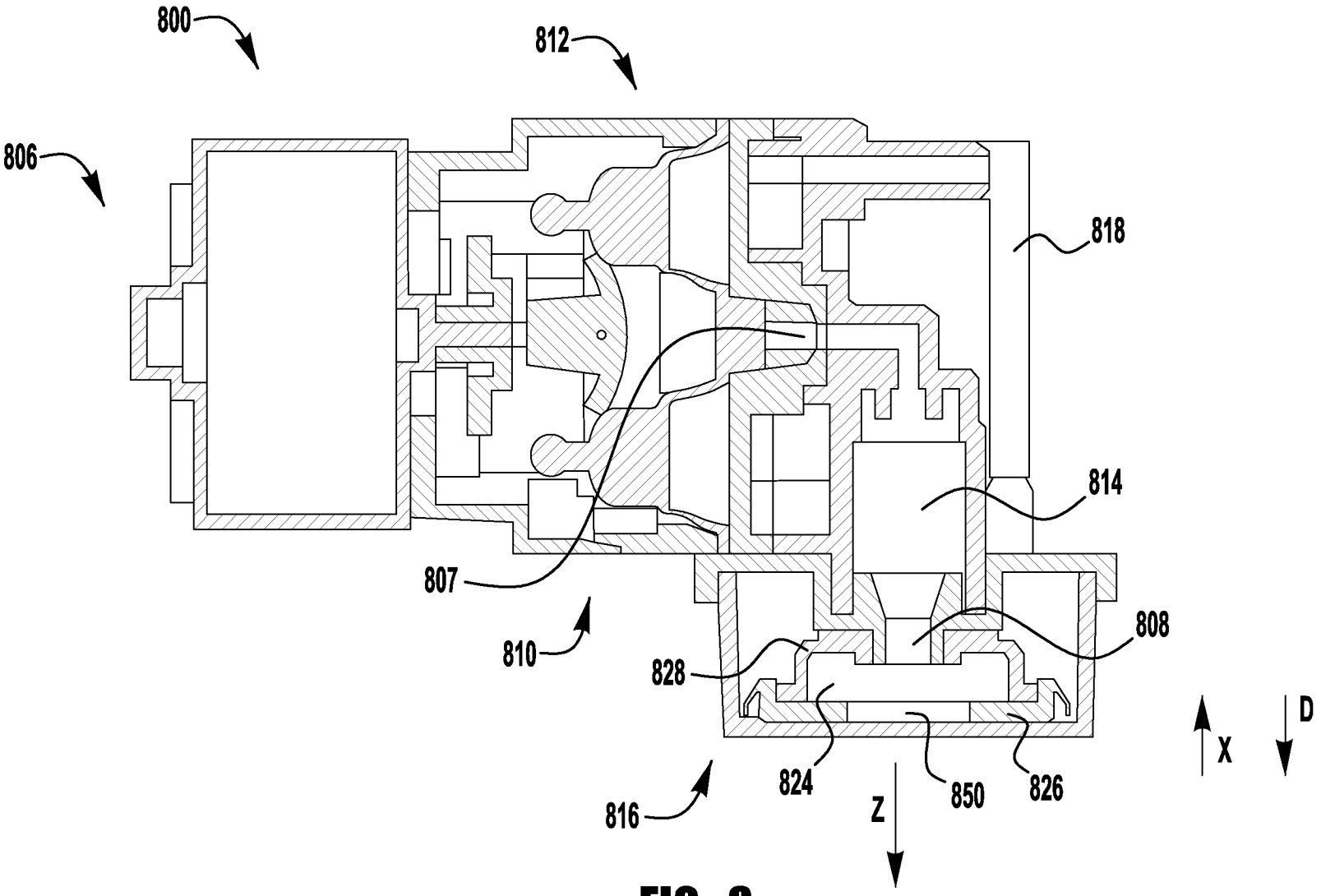
FIG. 8 is a cross-sectional view of another exemplary embodiment of a dispenser having a vacuum actuated suck-back mechanism for preventing residual foam or liquid from dripping out of an outlet of the dispenser.

FIG. 8 illustrates another exemplary embodiment of a portion of a dispenser 800. The exemplary dispenser 800 includes a housing (not shown), a container (not shown) for holding a foamable liquid, a foam pump 806, an outlet 808, and a vacuum actuated suck-back mechanism 816. In certain embodiments, the foam pump 806 includes a liquid pump portion 810 and an air pump portion 812. In certain embodiments, the foam pump 806 is a combination of the liquid pump and an air pump. In certain embodiments, a second air pump is used to create the vacuum pressure. During operation, the liquid pump portion 810 pumps liquid into a mixing chamber 807, the air pump portion 812 pumps air into the mixing chamber 807 to mix with the liquid in order to create a foamy mixture, and the foamy mixture passes through foaming cartridge 814 and exits the outlet 808 of the dispenser 800 as a rich foam. The foam pump 806 may take any suitable form that allows the foam pump to pump air and liquid through the outlet 808 of the dispenser 800, such as, for example, any form described or incorporated in the present application. Additionally, the dispenser 800 includes an actuator (not shown) that is used to activate the foam pump 806 in order to pump foam out of the outlet 808, and the actuator may take any suitable form that is capable of activating the foam pump, such as, for example, any form described or incorporated in the present application. In various embodiments, any combination of the container, the foam pump 806, the outlet 808, and the vacuum actuated suck-back mechanism 816 may be a part of a refill unit. In certain embodiments, the foam pump 806 and the vacuum actuated suck-back mechanism 816 are fixed to the housing of the dispenser 800.

The vacuum actuated suck-back mechanism 816 prevents residual foam/liquid from dripping from the outlet 808 after foam is dispensed. The vacuum actuated suck-back mechanism 816 is in fluid communication with the outlet 808 and the inlet of the air pump portion 812 of the foam pump 806. In certain embodiments, the dispenser 800 includes a vacuum line 818 that is in fluid communication with the vacuum actuated suck-back mechanism 816 and the inlet of the air pump portion 812 of the foam pump 806. In the illustrated embodiment, the chamber 824 of the vacuum actuated suck-back mechanism 816 is oriented concentric with the foam pump 806. In alternative embodiments, the chamber 824 of the vacuum actuated suck-back mechanism 816 may be orientated with the foam pump 806 in any manner that allows the chamber to be in fluid communication with the foam pump and to expand when the vacuum pressure is removed.

The vacuum actuated suck-back mechanism 816 includes a chamber 824 that is defined at least in part by a diaphragm 828 and a piston 826. The diaphragm 828 may be made of a resilient material. The chamber 824 is in line with the outlet 808, and the piston 826 includes an opening 850 that corresponds to the outlet, such that foam will travel through the outlet and the opening of the piston upon activation of the foam pump 806. The illustrated embodiment shows the vacuum actuated suck-back mechanism 816 in a rest position. In the rest position, the piston 826 remains in a first position, and the chamber 824 has a first volume.

During operation of the foam pump 806, the piston 826 moves to the second position. Foam pump 806 creates a vacuum in the chamber 824 of the vacuum actuated suck-back mechanism 816, and the vacuum causes the piston 826 to move in the direction X to the second position. The vacuum is created in the vacuum actuated suck-back mechanism 816 due to the connection between the vacuum actuated suck-back mechanism 816 and the inlet of the air pump portion 812. When the piston 426 is in the second position, the chamber 824 has the second volume, which is less than the first volume. In addition, creating a vacuum in the vacuum actuated suck-back mechanism 816, causes residual foam/liquid in chamber 824 to be forced out of the outlet 808 of the dispenser 800 in a direction Z.

The resiliency of the diaphragm 828 causes the piston 826 to move from the second position to the first position upon deactivation of the foam pump 806. Deactivation of the foam pump 806 removes the vacuum from the chamber 824 of the vacuum actuated suck-back mechanism 816, which causes diaphragm to move back to its rest position and moves the piston in the direction D to the first position. The movement of the piston 828 from the second position to the first position expands the volume of the chamber 824. This expansion of the volume of the chamber 824 causes residual foam/liquid that remains in the outlet 808 to be sucked into the chamber of the suck-back mechanism.

After the piston 826 moves from the second position to the first position, the vacuum actuated suck-back mechanism 816 remains in a rest position (and the piston 826 remains in the first position) until another activation of the foam pump 806. As the vacuum actuated suck-back mechanism 816 remains in the rest position, residual foam/liquid that was sucked into the vacuum actuated suck-back mechanism after the previous activation of the foam pump 806 remains in the chamber 824. Upon the next activation of the foam pump 806, the residual foam/liquid in the chamber 824 is forced through the outlet 808 of the dispenser 800, or the residual foam/liquid may be sucked through the vacuum line 818 and into the foam pump 806, which will cause the residual foam/liquid to be pumped into the mixing chamber 807. The above-mentioned process is continuous (i.e., the chamber 824 of the vacuum actuated suck-back mechanism 816 will continue to compress as foam is dispensed out of the outlet 808 upon activation of the foam pump 806 and to expand in order to suck foam out of the outlet upon deactivation of the foam pump).

While various inventive aspects, concepts and features of the inventions may be described and illustrated herein as embodied in combination with exemplary embodiments, these various aspects, concepts and features may be used in many alternative embodiments, either individually or in various combinations and sub-combinations thereof. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A dispenser comprising:
a dispenser housing;
a container for holding a foamable liquid;
a foam pump having a liquid pump portion and an air pump portion;
an outlet in fluid communication with the foam pump; and
a vacuum actuated suck-back mechanism having a chamber and a movable member, wherein the chamber has a vacuum port and a suck-back port, wherein the vacuum port is in fluid communication with the air pump portion of the foam pump, and wherein the suck-back port is in fluid communication with the outlet;
wherein the movable member moves under vacuum pressure to reduce a volume of the chamber, and wherein the volume of the chamber increases upon removal of the vacuum pressure.

2. The dispenser of claim 1, wherein the vacuum actuated suck-back mechanism comprises a resilient diaphragm.

3. The dispenser of claim 1, wherein the dispenser comprises a refill unit, and wherein the refill unit comprises the container, the foam pump, and the suck-back mechanism.

4. The dispenser of claim 1, wherein the foam pump is a sequentially activated diaphragm foam pump, wherein the liquid pump portion includes at least one liquid pumping diaphragm, and wherein the air pump portion includes at least two air pumping diaphragms.

5. The dispenser of claim 1, wherein the moveable member is a piston.

6. The dispenser of claim 5, wherein the piston has a first sealing member at a first end and a dynamic sealing member at a second end, wherein the dynamic sealing member allows fluid past the dynamic sealing member to increase the volume of the chamber.

7. The dispenser of claim 1, further comprising a biasing member.

8. The dispenser of claim 7, wherein the biasing member is a spring.

9. The dispenser of claim 6, wherein the chamber is at least partially defined by the first sealing member and a chamber end wall that is opposite the first sealing member.

10. A dispenser comprising:
a dispenser housing;
a container for holding a foamable liquid;
a first pump portion for pumping a liquid;
a second pump portion for pumping air;
an outlet in fluid communication the first pump portion; and
a chamber at least partially defined by a movable member, the chamber having:
a vacuum inlet, wherein the vacuum inlet is in fluid communication with the air pump portion;
a suck-back inlet, wherein the suck-back inlet is in fluid communication with the outlet;
wherein applying a vacuum pressure to the vacuum inlet causes the volume of the chamber to decrease; and
wherein removing the vacuum pressure from the vacuum inlet causes the volume of the chamber to increase; and
wherein increasing the volume of the chamber draws residual fluid from the outlet toward the chamber.

11. The dispenser of claim 10, wherein the chamber is defined at least in part by a resilient diaphragm.

12. The dispenser of claim 10, wherein the dispenser comprises a refill unit, and wherein the refill unit comprises the container, the first pump portion, the second pump portion, and the chamber.

13. The dispenser of claim 10, further comprising a foam pump having the first pump portion and the second pump portion, wherein the foam pump is a sequentially activated diaphragm foam pump, wherein the first pump portion includes at least one liquid pumping diaphragm, and wherein the second pump portion includes at least two air pumping diaphragms.

14. The dispenser of claim 10, wherein the first pump portion and the second pump portion are in the same pump.

15. The dispenser of claim 10, further comprising a biasing member.

16. The dispenser of claim 15, wherein the biasing member is a spring.

17. The dispenser of claim 10, wherein the moveable member is a piston.

18. The dispenser of claim 17, wherein the piston has a first sealing member at a first end and a dynamic sealing member at a second end, wherein the dynamic sealing member allows fluid past the dynamic sealing member to increase the volume of the chamber.

19. The dispenser of claim 18, wherein the chamber is at least partially defined by the first sealing member and a chamber end wall that is opposite the first sealing member.

20. A dispenser comprising:
a dispenser housing;
a container for holding a foamable liquid;
a sequentially activated multi-diaphragm pump;
the sequentially activated multi-diaphragm pump having
a first pump portion for pumping a liquid;
a second pump portion for pumping air; and
a third pump portion for pumping air;
wherein the first pump portion, the second pump portion and the third pump portion are activated sequentially;
an outlet in fluid communication the first pump portion; and
a chamber at least partially defined by a movable member, the chamber having:
a vacuum inlet, wherein the vacuum inlet is in fluid communication with the air pump portion;
a suck-back inlet, wherein the suck-back inlet is in fluid communication with the outlet;
wherein applying a vacuum pressure to the vacuum inlet causes the volume of the chamber to decrease; and
wherein removing the vacuum pressure from the vacuum inlet causes the volume of the chamber to increase; and
wherein increasing the volume of the chamber draws residual fluid from the outlet toward the chamber.

* * * * *